US007227298B2

(12) United States Patent
Takahashi et al.

(10) Patent No.: US 7,227,298 B2
(45) Date of Patent: Jun. 5, 2007

(54) COLOR PICTURE TUBE AND METHOD FOR MANUFACTURING THE SAME

(75) Inventors: Toru Takahashi, Takatsuki (JP); Hiroyuki Oda, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/295,265

(22) Filed: Dec. 6, 2005

(65) Prior Publication Data

US 2006/0132018 A1 Jun. 22, 2006

(30) Foreign Application Priority Data

Dec. 17, 2004 (JP) ..... 2004-366571

(51) Int. Cl.
*H01J 29/07* (2006.01)
*H01J 29/02* (2006.01)

(52) U.S. Cl. ..... 313/402; 445/47

(58) Field of Classification Search ..... 313/402–408; 445/47

See application file for complete search history.

(56) References Cited

U.S. PATENT DOCUMENTS 5,910,702 A * 6/1999 Maehara ..... 313/407
5,929,558 A * 7/1999 Lee ..... 313/402
6,043,595 A 3/2000 Yokoyama et al.
6,724,136 B1 * 4/2004 Kim et al. ..... 313/402

FOREIGN PATENT DOCUMENTS

| | | |
|---|---|---|
| JP | 1-21848 | 1/1989 |
| JP | 1-197941 | 8/1989 |
| JP | 3-88240 | 4/1991 |
| JP | 5-74364 | 3/1993 |
| JP | 7-29505 | 1/1995 |
| JP | 8-106856 | 4/1996 |
| JP | 10-199439 | 7/1998 |
| JP | 2002-313254 | 10/2002 |
| JP | 2002313254 A * | 10/2002 |

* cited by examiner

*Primary Examiner*—Karabi Guharay
(74) *Attorney, Agent, or Firm*—Hamre, Schumann, Mueller & Larson, P.C.

(57) ABSTRACT

A phosphor screen is formed on an inner surface of a face portion whose outer surface is substantially flat. A shadow mask faces the phosphor screen. The shadow mask includes a perforated portion having a plurality of apertures, a non-perforated portion formed on a periphery of the perforated portion and a skirt portion formed on a periphery of the non-perforated portion. The non-perforated portion includes a pair of longer side portions each having an outer bead and an inner bead that are adjacent to each other and a pair of shorter side portions each having the outer bead and an inner bead that are adjacent to each other. In each of the pair of longer side portions, the spacing between the outer bead and the inner bead is at least 2 mm. This makes it possible to suppress wavy wrinkles generated in the perforated portion, so that the image quality of a color picture tube can be improved.

4 Claims, 5 Drawing Sheets

COLOR PICTURE TUBE AND METHOD FOR MANUFACTURING THE SAME

BACKGROUND OF THE INVENTION

1. Field of the Invention

The present invention relates to a color picture tube and a method for manufacturing the same. More specifically, the present invention relates to a shape of a shadow mask provided in a color picture tube and a method for forming the shadow mask.

2. Description of Related Art

The following is a description of a conventional typical color picture tube. FIG. 5 is a schematic sectional view showing an exemplary structure of the conventional color picture tube. The color picture tube includes an envelope having a panel 1 and a funnel 2, and a space inside the envelope is maintained under vacuum. The panel 1 has a face portion 1A and a skirt portion 1B formed on the periphery of the face portion 1A. An outer surface of the face portion 1A is substantially rectangular. The funnel 2 is joined with the skirt portion 1B of the panel 1 on its larger dimension side.

An inner surface of the face portion 1A is provided with a phosphor screen 3. The phosphor screen 3 has a plurality of black light absorption layers and a plurality of tricolor phosphor layers. Each of the black light absorption layers has a striped shape extending along a minor axis direction of the panel 1, and the plurality of black light absorption layers are arranged in parallel with a predetermined gap therebetween in a major axis direction. Each of the plurality of tricolor phosphor layers has a striped shape extending along the minor axis direction of the panel 1 and is arranged sequentially in the gap between the plurality of black light absorption layers.

An electron gun 4 is provided in a space inside a cylindrical neck portion 2A of the funnel 2. The electron gun 4 usually is an in-line electron gun, which emits in a tube axis direction three electron beams consisting of a center beam and a pair of side beams on both sides aligned in a horizontal axis direction (the major axis direction).

Further, a deflection yoke (a deflector) 5 is mounted on an outer peripheral surface of the funnel 2. The deflection yoke 5 has a horizontal deflection coil and a vertical deflection coil for forming a deflection magnetic field and deflects the three electron beams emitted from the electron gun 4 by a magnetic action.

In the space inside the envelope, a shadow mask 106 is provided so as to be spaced away from and face the phosphor screen 3. The shadow mask 106 is broadly grouped into a dome-like press-formed mask formed by press work and a substantially flat tension mask stretched and fixed by a mask frame 7. It is noted that, when simply referring to a shadow mask in the present specification, it means a press-formed mask.

The mask frame 7 for fixing the shadow mask 106 is attached to the panel 1 in a freely detachable manner by engagement through an elastic support (not shown) fixed to the mask frame 7 and a stud pin (not shown) provided in the skirt portion 1B of the panel 1 so as to protrude therefrom.

Now, an exemplary structure of the shadow mask will be described in detail. FIG. 6 is a schematic perspective view showing an exemplary structure of the shadow mask. As shown in FIG. 6, the shadow mask 106 has a perforated portion (a useful portion) 61 in which many apertures through which the three electron beams for displaying an image pass (electron beam passing apertures, not shown) are formed in a predetermined arrangement, a non-perforated portion (a nonuseful portion) 162 formed on the periphery of the perforated portion 61, and a skirt portion 63 formed on the periphery of the non-perforated portion 162. The skirt portion 63 is fixed to the mask frame 7 (see FIG. 5) by welding or the like. As shown in the figure, an axis that is parallel with a longer side of the substantially rectangular perforated portion 61 and perpendicular to a tube axis is set as a major axis, whereas an axis that is perpendicular to the major axis and the tube axis is set as a minor axis. Usually, the skirt portion 63 is welded to the mask frame 7 at positions where the minor axis crosses the skirt portion 63 or a vicinity thereof, positions where the major axis crosses it or a vicinity thereof, and diagonal edges or a vicinity thereof.

The many apertures in the perforated portion 61 individually form a plurality of aperture trains that are substantially parallel with the minor axis direction. The plurality of aperture trains are arranged along the major axis direction at a predetermined pitch. The pitch of the aperture trains varies from the center of the perforated portion 61 to the periphery thereof in the major axis direction and usually increases gradually from the center toward the periphery along the major axis direction. A plurality of apertures forming each aperture train are aligned substantially in parallel with the minor axis direction via bridges (not shown). Positions of apertures in adjacent aperture trains in the minor axis direction are shifted by ½ of the pitch of the apertures in the minor axis direction. In other words, the apertures in the plurality of aperture trains are arranged in a so-called staggered manner. Each of the apertures has an elongated substantially rectangular shape, with its longitudinal direction being parallel with the minor axis direction and its lateral direction (width direction) being parallel with the major axis direction. Each of the apertures is a communication aperture in which a larger aperture (not shown) that opens to the surface on the side of the phosphor screen 3 (see FIG. 5) and a smaller aperture (not shown) that opens to the surface on the side of the electron gun 4 (see FIG. 5) are in communication with each other.

Each of the three electron beams passes each aperture of the perforated portion 61 and then reaches only a phosphor layer with a specific color among the tricolor phosphor layers constituting the phosphor screen 3. In other words, the shadow mask 106 is provided for color selection of the three electron beams.

In the color picture tube shown in FIG. 5, the three electron beams emitted from the electron gun 4 are deflected in the major axis direction and the minor axis direction by the deflection magnetic field generated by the deflection yoke 5, pass through the apertures of the shadow mask 106, and scan the phosphor screen 3 in the major axis direction and the minor axis direction. In this manner, a color image is displayed on the phosphor screen 3.

For improving the visibility of displayed images, the screen has become increasingly flatter, so that the outer surface of the face portion 1A has become substantially flat (has a radius of curvature of at least 10000 mm) and the inner surface of the face portion 1A also has achieved a high flatness. Since the curved shape of the shadow mask 106 (a curved mask surface) generally depends on the shape of the inner surface of the face portion 1A, the flattening of the inner surface of the face portion 1A also increases the flatness of the curved shape of the shadow mask 106.

Herein, a general method for producing the shadow mask 106 will be explained. A rolled-up elongated mask base is unrolled and then provided with many apertures for color selection by a photo-etching treatment while being carried in its longitudinal direction. Subsequently, the mask base is cut into a predetermined size, thus producing a flat mask. After the flat mask is annealed, it is subjected to press work, thereby deforming the flat mask plastically. By the processes described above, the shadow mask 106 is produced.

The following is a detailed description of the press work for producing the shadow mask 106. FIGS. 7A to 7F are drawings for describing the press work. First, as shown in FIG. 7A, an annealed flat mask 16 is put into a press working machine. Incidentally, the annealing is performed for simplifying the press work. The press working machine includes a mask die that is roughly divided into a punch 11, a knockout 12, a die 13 and a blank holder 14. A lower surface P1 of the punch 11 has a shape corresponding to the shapes of the perforated portion and the non-perforated portion of the shadow mask to be produced. The knockout 12 facing the punch 11 has a protruding portion 12*a* for clamping the flat mask 16 between the protruding portion 12*a* and the punch 11 and a recessed portion 12*b* for receiving the perforated portion that extends toward the recessed portion 12*b* at the time of pressing. An upper surface P2 of the protruding portion 12*a* has a shape corresponding to the shape of the non-perforated portion of the shadow mask to be produced. The die 13 and the blank holder 14 that face each other are arranged around the punch 11 and the knockout 12.

Next, as shown in FIG. 7B, the blank holder 14 is lowered, so that the die 13 and the blank holder 14 hold the flat mask 16. Subsequently, as shown in FIG. 7C, the punch 11 is lowered, thus deforming the perforated portion and the non-perforated portion so as to extend downward. Thereafter, as shown in FIG. 7D, the blank holder 14 alone is lifted. Then, as shown in FIG. 7E, the punch 11 and the knockout 12 are lowered while keeping the flat mask 16 clamped therebetween, thus forming the skirt portion with the punch 11 and the die 13. Finally, as shown in FIG. 7F, the punch 11 is lifted, and the completed shadow mask 106 is taken out from the press working machine.

In press work, as the curved mask surface of the shadow mask 106 to be produced becomes flatter (the radius of curvature increases), it is more difficult to deform the flat mask 16 plastically. This is because, as the curved mask surface becomes flatter, the difference between the length along the surface of the perforated and non-perforated portions of the flat mask 16 before press work and the arc length along the surface of the perforated and non-perforated portions of the shadow mask 106 after press work decreases, thereby reducing the amount that the perforated portion is stretched during the press work. Accordingly, in the case of producing a highly-flat shadow mask 106, a technology has been adopted in which one or more lines of beads (not shown) are formed in the non-perforated portion, making it easier to achieve plastic deformation (see JP 7(1995)-29505 A, JP 8(1996)-106856 A and JP 2002-313254 A, for example).

Here, the shadow mask having the beads will be described in detail. FIG. 8 is a schematic front view showing an exemplary structure of a conventional shadow mask having two lines of beads. FIG. 9 is a schematic sectional view showing in detail a part of the exemplary structure of the conventional shadow mask having the two lines of beads. Incidentally, FIG. 9 shows a cross-section taken along the minor axis of the shadow mask. As shown in FIGS. 8 and 9, an outer bead 108 is formed in the non-perforated portion 162 so as to surround the perforated portion 61, and an inner bead 109A and an inner bead 109B respectively are formed in a pair of longer side portions 162A and a pair of shorter side portions 162B of the non-perforated portion 162 so as to be located between the perforated portion 61 and the outer bead 108.

For press work for producing the shadow mask shown in FIGS. 8 and 9, the press working machine shown in FIG. 7A uses a mask die in which the upper surface P2 of the protruding portion 12*a* of the knockout 12 is provided with two lines of ridge-like projections (not shown) and the lower surface P1 of the punch 11 is provided with two lines of groove-like depressions (not shown) having a shape corresponding to the projections of the knockout. By forming the beads with the two lines of projections of the knockout 12 and the two lines of depressions of the punch 11, the perforated portion 61 is stretched strongly outward (in a direction away from the tube axis) so as to increase the extending amount at the time of pressing, making it easier to achieve plastic deformation.

In press work, generally, the flat mask 16 serving as an object to be processed, in particular, the non-perforated portion 162 thereof, has to be fixed firmly. Accordingly, a portion of the mask die corresponding to the non-perforated portion 162 partially has been processed for engagement (rubbing for engagement). In order to fix the flat mask 16 as a whole uniformly, the rubbing for engagement is provided in a region in the mask die completely surrounding the portion corresponding to the perforated portion 61. The region subjected to the rubbing for engagement in the mask die is referred to as a "rubbed region for engagement." Conventionally, this rubbing for engagement has been provided in the region of the mask die corresponding to a region between the perforated portion 61 and the bead on the inner most side (the side of the perforated portion). It should be noted that a region in the mask die other than the rubbed region for engagement is left as a machine-processed surface.

The rubbing for engagement is a fine hand finishing on a machine-processed surface by an individual worker for allowing the punch 11 (see FIG. 7A) and the protruding portion 12*a* of the knockout 12 (see FIG. 7A) to contact closely. The rubbing for engagement is carried out as follows. Pounce is applied to the rubbed region for engagement of one of the punch 11 and the knockout 12. In this state, stamping is performed without inserting the flat mask 16 (see FIG. 7A). The adhesion of the pounce to the other rubbed region is observed, and when there is a portion to which no pounce adheres or an unevenness of the adhering pounce, the corresponding portion of the punch 11 or the knockout 12 is rubbed manually. This is repeated until the adhesion of the pounce becomes uniform.

The rubbing for engagement is performed locally in the rubbed region for engagement by a manual work. Thus, although the rubbing for engagement allows the upper and lower mask dies to contact closely within the rubbed region for engagement, it may deteriorate a working accuracy of the rubbed region for engagement of the mask die with respect to the surface shape as a whole. In other words, the rubbing for engagement causes a work unevenness in the mask die. For example, there are some cases where a surface that is supposed to be flat is processed into a curved surface or a wavy uneven surface by the rubbing for engagement. Even in such cases, as long as the rubbed region for engagement of the punch 11 and that of the knockout 12 have surface shapes corresponding to each other, it still is possible to allow them to contact closely. However, in this case, because of the work unevenness in the rubbed region for engagement, wavy wrinkles are generated in the shadow mask to be formed using this mask die.

Conventionally, the rubbed region for engagement has been located in the region of the mask die corresponding to the region between the perforated portion 61 and the inner most bead, and at the time of forming the curved surface of the perforated portion 61, the flat mask 16 has been clamped at this rubbed region for engagement. Thus, owing to the above-described work unevenness in the rubbed region for engagement in the mask die, the wrinkles have reached the perforated portion 61. In particular, a wide-type color picture tube whose aspect ratio (major axis length:minor axis length) is 16:9 is more markedly affected by the work unevenness because of its higher flatness of the perforated portion 61, compared with a color picture tube whose aspect ratio is 4:3.

The wrinkles in the perforated portion 61 are more likely to be generated in a central part of the perforated portion 61 than in the peripheral part thereof. This is because the radius of curvature of the perforated portion 61 in the minor axis direction is largest in the vicinity of the minor axis and decreases with distance away therefrom along the major axis and the radius of curvature thereof in the major axis direction is largest in the vicinity of the major axis and decreases with distance away therefrom along the minor axis. Furthermore, the generation of wrinkles in the central part of the perforated portion 61 is affected more greatly by the work unevenness in the portion of the mask die corresponding to the longer side portion 162A of the non-perforated portion 162 of the shadow mask rather than by the work unevenness in the portion of the mask die corresponding to the shorter side portion 162B thereof. This is because the radius of curvature of the central part of the perforated portion 61 generally is larger in the minor axis direction than in the major axis direction.

Even when very shallow wrinkles are generated in the perforated portion 61, the durability of the curved shape of the shadow mask against impact or the like (mask strength) decreases, so that the shadow mask itself becomes easy to deform by an external force. The deformation of the shadow mask has reduced yield in a manufacturing process of the color picture tube and deteriorated the image quality in the color picture tube. Moreover, when wrinkles are generated in the perforated portion 61, it is more likely that vibrations due to an external impact, a sound or the like causes vibrations (mask vibrations) in the perforated portion 61. Because of the generated mask vibrations, swaying images are formed when the images are displayed, thus lowering the image quality. Especially in the case of a color picture tube for television, since the shadow mask (the screen size) is large, the lowering of mask strength and the generation of mask vibrations caused by the wrinkles in the perforated portion 61 become more conspicuous.

SUMMARY OF THE INVENTION

Accordingly, it is an object of the present invention to suppress the generation of wavy wrinkles in a perforated portion of a shadow mask. It is a further object of the present invention to suppress the lowering of the mask strength and the generation of mask vibrations, thereby improving an image quality.

A color picture tube according to the present invention includes an envelope including a panel having a face portion whose outer surface is substantially flat, and a funnel having a neck portion; a phosphor screen formed on an inner surface of the face portion; an electron gun disposed in a space inside the neck portion; and a shadow mask that is spaced away from and faces the phosphor screen. The shadow mask includes a perforated portion having a plurality of apertures, a non-perforated portion, formed on a periphery of the perforated portion, including a pair of longer side portions each having an outer bead and an inner bead that are adjacent to each other and a pair of shorter side portions each having an outer bead and an inner bead that are adjacent to each other, and a skirt portion formed on a periphery of the non-perforated portion. In each of the pair of longer side portions, a spacing between the outer bead and the inner bead is at least 2 mm.

A method for manufacturing a color picture tube according to the present invention includes forming the plurality of apertures in a mask base so as to form a flat mask, and press-forming the flat mask using a pair of dies so as to form the outer bead and the inner bead in each of the pair of longer side portions. One of the pair of dies is provided with two lines of projections for forming the outer bead and the inner bead in each of the pair of longer side portions, and the other is provided with two lines of depressions into which the two lines of projections are fitted, respectively. A spacing between the two lines of projections is at least 2 mm, and at least one of a region between the two lines of projections and a region between the two lines of depressions has been subjected to rubbing for engagement.

DETAILED DESCRIPTION OF THE INVENTION

In the present invention, the spacing between the outer bead and the inner bead in each of the pair of longer side portions in the shadow mask is set to at least 2 mm, whereby the region between the outer bead and the inner bead in each of the pair of longer side portions can be clamped at the rubbed region for engagement in the mask die during press work. Consequently, it is possible to suppress the generation of wrinkles in the perforated portion caused by work unevenness in rubbing for engagement, thereby improving the image quality.

Figure 5:
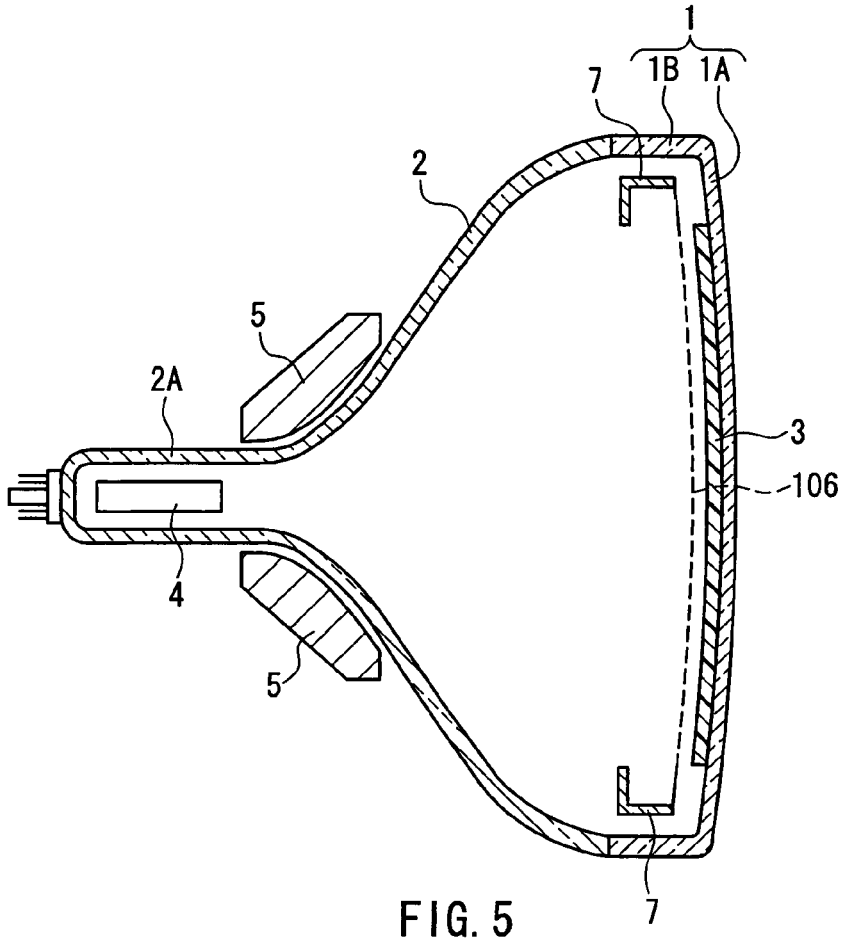
FIG. 5 PRIOR ART
FIG. 5 is a schematic sectional view showing an exemplary structure of a conventional color picture tube.
Figure 6:
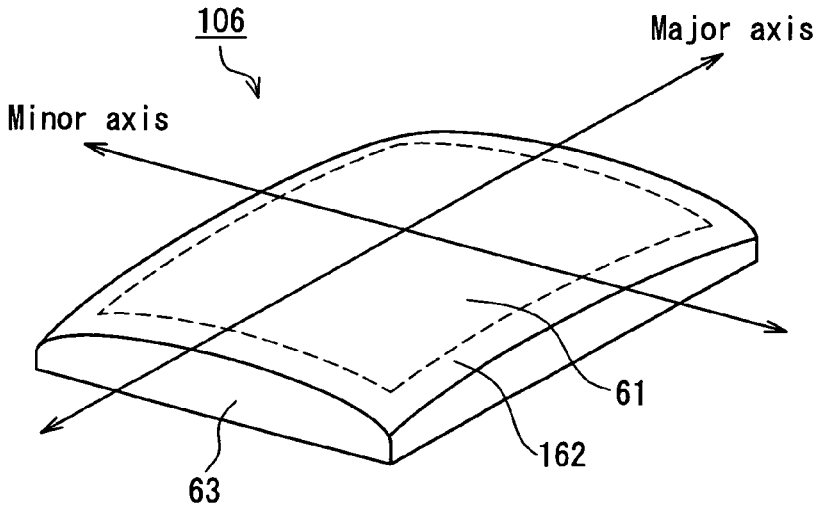
FIG. 6 PRIOR ART
FIG. 6 is a schematic perspective view showing an exemplary structure of a shadow mask in the conventional color picture tube.

The following is a description a color picture tube according to the present invention. It should be noted that the color picture tube according to the present invention may have the same configuration as any known color picture tubes for portions other than a shadow mask. The color picture tube in an embodiment according to the present invention may have the same configuration as the color picture tube shown in FIG. 5, for example, for the portions other than the shadow mask. The specific description of members that are the same as those in FIG. 5 will be omitted.

Figure 1:
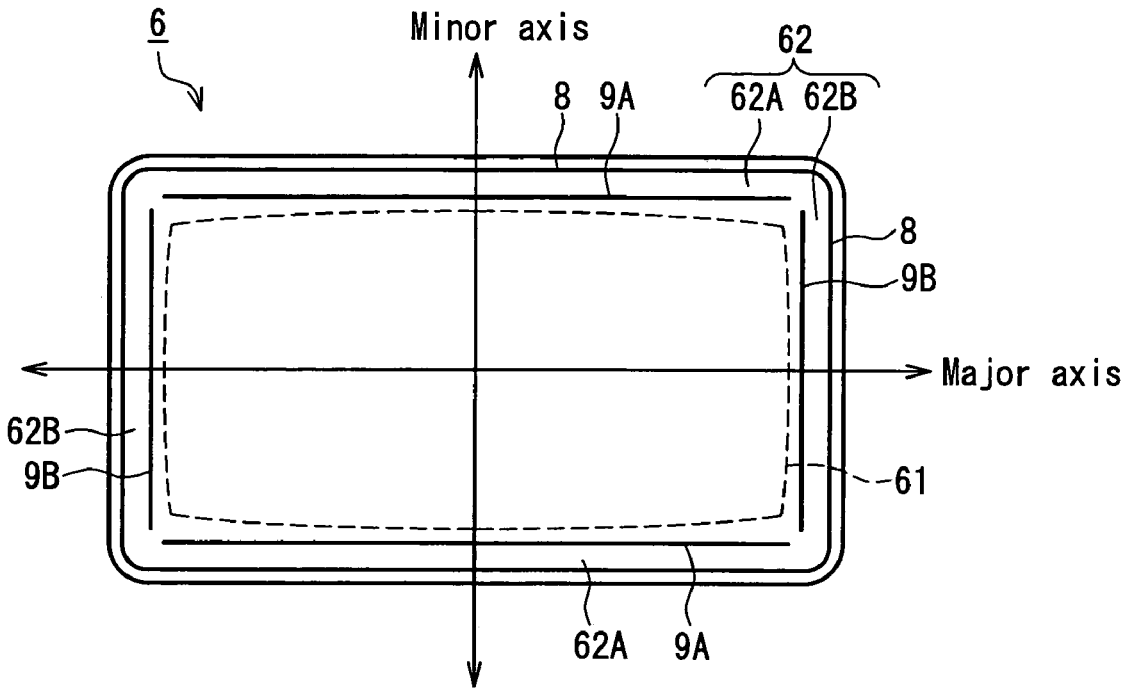
FIG. 1 is a schematic plan view showing an exemplary structure of a shadow mask in a color picture tube according to an embodiment of the present invention.

FIG. 1 is a schematic plan view showing an exemplary structure of a shadow mask in a color picture tube according to an embodiment of the present invention. A shadow mask 6 of the present invention may have the same configuration as any known shadow masks except that the positional relationship between an outer bead and an inner bead in the non-perforated portion 62 is different. In the following, the specific description of the configuration other than the outer bead and the inner bead will be omitted.

As shown in FIG. 1, the shadow mask 6 includes a perforated portion 61, a non-perforated portion 62 having a pair of longer side portions 62A in which an outer bead 8 and an inner bead 9A are formed so as to be adjacent to each other and a pair of shorter side portions 62B in which the outer bead 8 and an inner bead 9B are formed so as to be adjacent to each other, and a skirt portion (not shown). The widths of the outer bead 8, the inner bead 9A and the inner bead 9B are selected suitably from the range of approximately 2 to 3 mm in view of the shape of the curved mask surface, the thickness of the shadow mask, etc.

Figure 2:
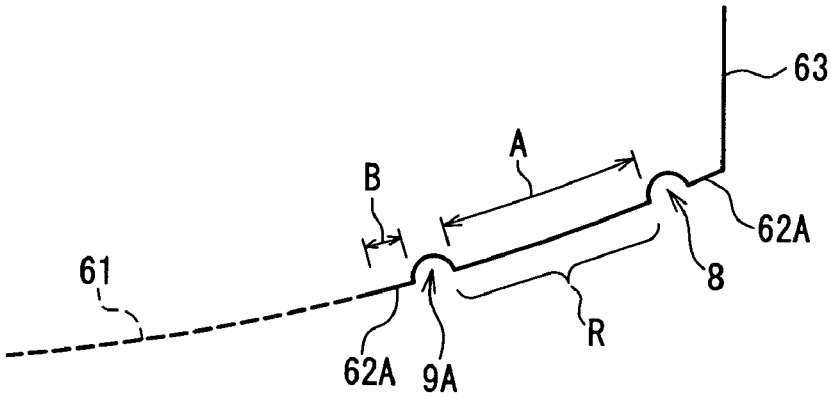
FIG. 2 is a schematic sectional view showing in detail a part of the exemplary structure of the shadow mask in the color picture tube according to an embodiment of the present invention.

FIG. 2 is a sectional view showing a part of the exemplary structure of the shadow mask 6 in the color picture tube according to an embodiment of the present invention. FIG. 2 shows a cross-section taken along the minor axis of the shadow mask 6. As shown in FIG. 2, the outer bead 8 has to be formed near a skirt portion 63 for forming the skirt portion 63 to be as parallel as possible with the tube axis. Thus, the outer bead 8 is formed at substantially the same position as the conventional outer bead 108 shown in FIG. 9.

In each of the pair of longer side portions 62A in the non-perforated portion 62, the spacing A between the inner bead 9A and the outer bead 8 that are adjacent to each other is at least 2 mm. The spacing A between the inner bead 9A and the outer bead 8 is larger than that in the conventional case, and the spacing B between the inner bead 9A and the perforated portion 61 is smaller than that in the conventional case. Incidentally, the spacing A between the inner bead 9A and the outer bead 8 refers to the distance from an end of the inner bead 9A on the side of the outer bead 8 to an end of the outer bead 8 on the side of the inner bead 9A. Similarly, it is preferable that, in each of the pair of shorter side portions 62B in the non-perforated portion 62, the spacing between the inner bead 9B and the outer bead 8 that are adjacent to each other is at least 2 mm.

The method for manufacturing a color picture tube according to the present invention may be the same as any known manufacturing methods except that the surface of the punch 11 and that of the knockout 12 that hold the flat mask 16 in steps of press-forming the shadow mask 6 shown in FIGS. 7A to 7F have different shapes from known surfaces. Accordingly, the specific description other than the shapes of the surfaces of the punch 11 and the knockout 12 for holding the flat mask 16 will be omitted.

Figure 3:
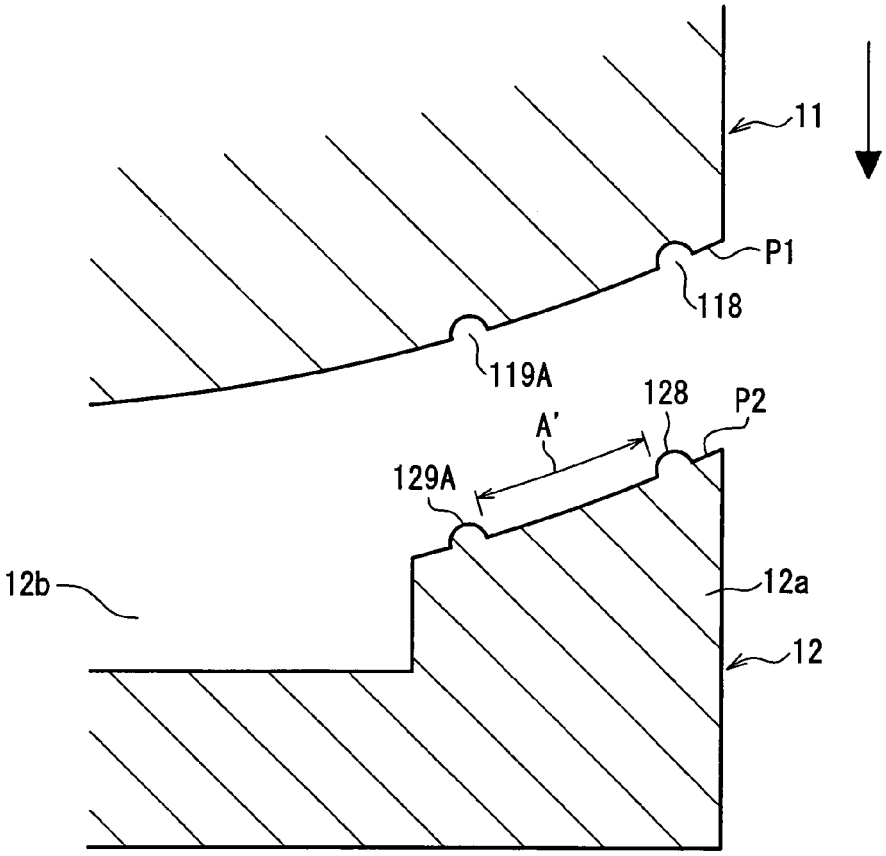
FIG. 3 is a sectional view showing a mask die for firmly holding a longer side portion of a shadow mask when press-forming the shadow mask to be mounted in the color picture tube according to an embodiment of the present invention.

FIG. 3 is a sectional view showing the punch 11 and the knockout 12 for firmly holding the longer side portions 62A of the shadow mask 6 at the time of press-forming the shadow mask 6. The cross-section of FIG. 3 is taken at a position corresponding to that of FIG. 2.

As shown in FIG. 3, the upper surface P2 of the protruding portion 12*a* of the knockout 12 is provided with two adjacent lines of ridge-like projections 128 and 129A, and the lower surface P1 of the punch 11 is provided with two lines of groove-like depressions 118 and 119A into which the two lines of ridge-like projections 128 and 129A are to be fitted, respectively.

As described above, the flat mask 16 whose perforated portion 61 is provided with many apertures is put between the punch 11 and the knockout 12, and then the punch 11 is lowered. In this manner, while the flat mask 16 is held firmly by the lower surface P1 of the punch 11 and the upper surface P2 of the protruding portion 12*a* of the knockout 12, the lower surface P1 provides the perforated portion 61 with a desired curved shape. At the same time, the two lines of ridge-like projections 128 and 129A and the two lines of groove-like depressions 118 and 119A form the outer bead 8 and the inner bead 9A in the longer side portion 62A.

In the present invention, the spacing A' between the projection 128 and the projection 129A is at least 2 mm. The spacing A between the projection 128 and the projection 129A refers to the distance from an end of the projection 128 on the side of the projection 129A to an end of the projection 129A on the side of the projection 128.

Figure 7A:
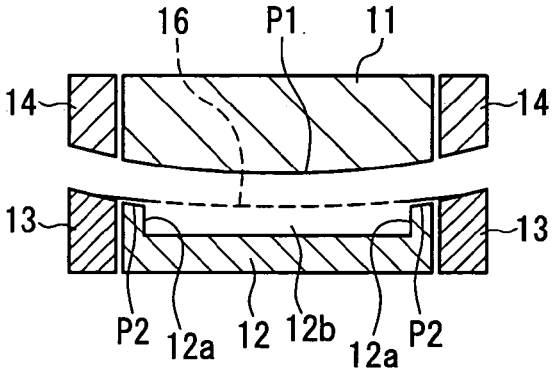
FIG. 7A PRIOR ART
FIGS. 7A to 7F are drawings for describing press work for forming the conventional shadow mask.
Figure 7D:
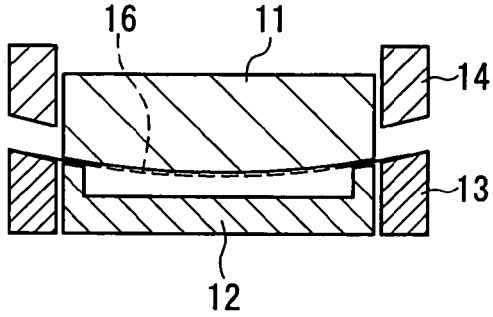
FIG. 7D PRIOR ART
Figure 7B:
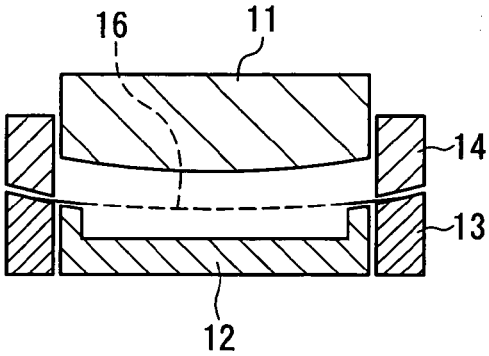
FIG. 7B PRIOR ART
Figure 7E:
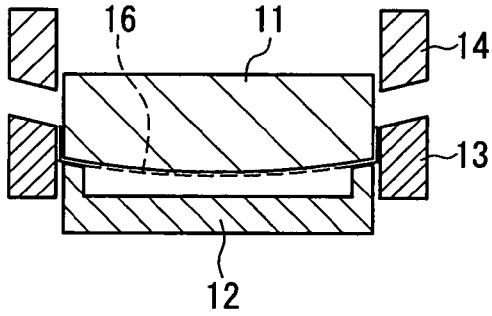
FIG. 7E PRIOR ART
Figure 7C:
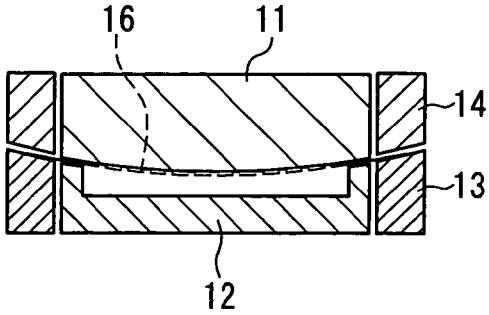
FIG. 7C PRIOR ART
Figure 7F:
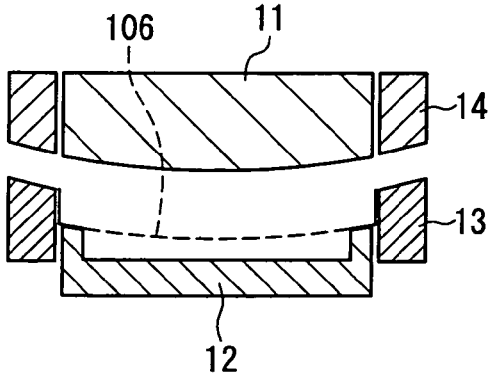
FIG. 7F PRIOR ART

At least one of the region between the depression 118 and the depression 119A and the region between the projection 128 and the projection 129A is subjected to rubbing for engagement. Therefore, when the punch 11 is lowered as shown in FIG. 7C, this region subjected to the rubbing for engagement (the rubbed region for engagement) allows the flat mask 16 to be fixed uniformly and firmly. Unlike the conventional mask die, no rubbing for engagement is provided in the region inside (on the tube axis side with respect to) the depression 119A in the lower surface P1 of the punch 11 and the region inside (on the tube axis side with respect to) the projection 129A in the upper surface P2 of the knockout 12.

Although not shown in the figure, in order to form the inner bead 9B and the outer bead 8 of each of the pair of shorter side portions 62B, the upper surface P2 of the protruding portion 12*a* of the knockout 12 that holds firmly the pair of shorter side portions 62B is provided with two lines of ridge-like projections and the lower surface P1 of the punch 11 that holds firmly the pair of shorter side portions 62B is provided with two lines of groove-like depressions into which these two lines of ridge-like projections are to be fitted, respectively, similarly to FIG. 3. It also is preferable that the spacing between these two lines of ridge-like projections is at least 2 mm. Further, it is preferable that at least one of the region between these two lines of depressions and the region between the two lines of projections is subjected to the rubbing for engagement. Moreover, it is preferable that the region inside the inner depression in the lower surface P1 of the punch 11 and the region inside the inner projection in the upper surface P2 of the knockout 12 are not subjected to the rubbing for engagement.

In the present invention, the rubbing for engagement is provided in the region of the mask die corresponding to the region between the inner bead 9A and the outer bead 8. Further, it is preferable that the rubbing for engagement is provided in the region of the mask die corresponding to the region between the inner bead 9B and the outer bead 8. It is preferable that the spacing between the inner bead 9A and the outer bead 8 and that between the inner bead 9B and the outer bead 8, which are the regions subjected to the rubbing for engagement, are both not greater than 8 mm. If the spacing between the inner bead 9A and the outer bead 8 and that between the inner bead 9B and the outer bead 8 exceed 8 mm, the rubbed region for engagement of the mask die expands, making it difficult to process the entire region with a uniform accuracy and increasing the time required for the rubbing for engagement considerably. For the same reason, it is preferable that the spacing between the two adjacent ridge-like projections formed on the upper surface P2 of the protruding portion 12*a* of the knockout 12 is not greater than 8 mm. In the following description, a region on the shadow mask corresponding to the region subjected to the rubbing for engagement in the mask die (the rubbed region for engagement) is referred to as a "region corresponding to the rubbed region for engagement."

Figure 8:
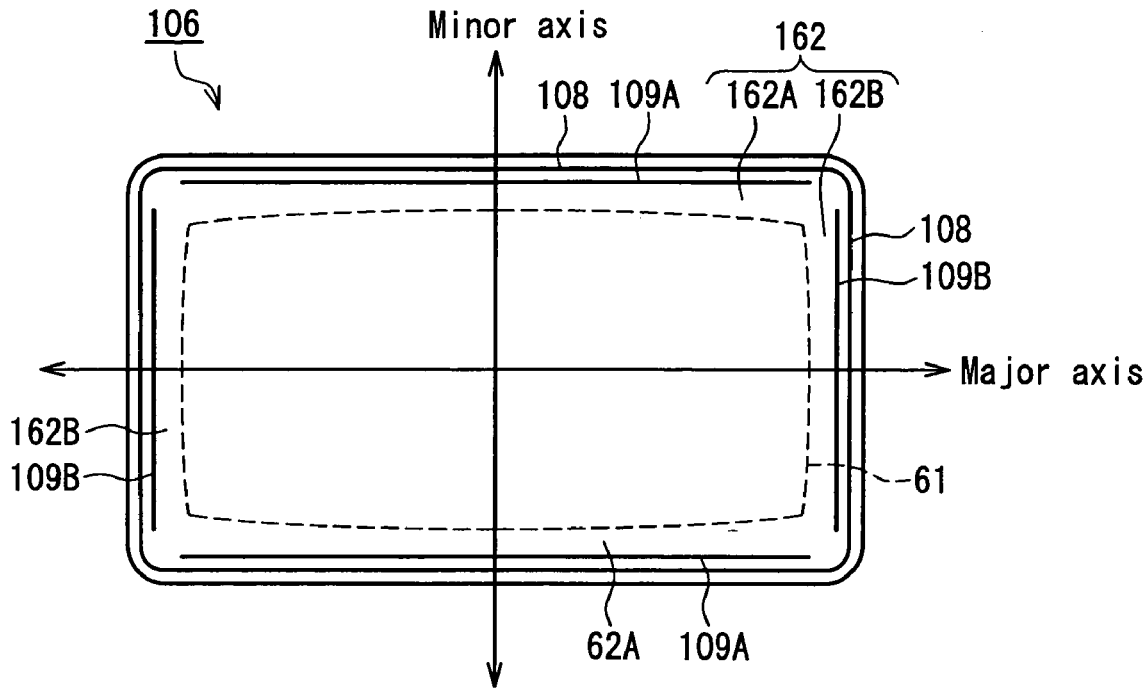
FIG. 8 PRIOR ART
FIG. 8 is a schematic plan view showing an exemplary structure of a shadow mask having two lines of beads in the conventional color picture tube.
Figure 9:
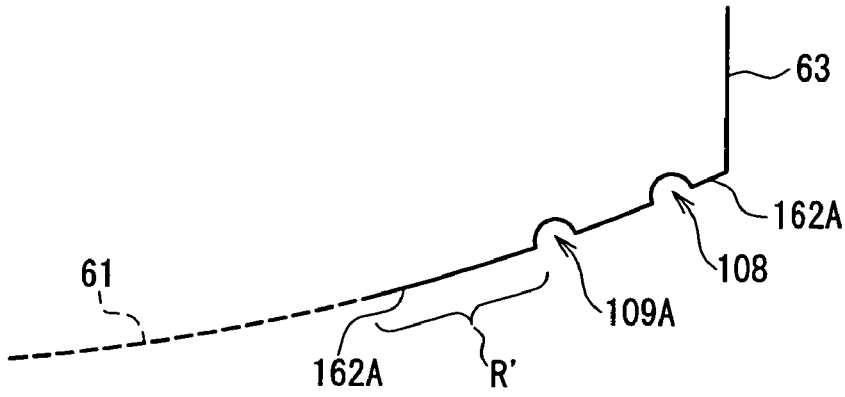
FIG. 9 PRIOR ART
FIG. 9 is a schematic sectional view showing in detail a part of the exemplary structure of the shadow mask having the two lines of beads in the conventional color picture tube.

When the spacing between the inner bead 9A, 9B and the outer bead 8 is set to at least 2 mm, the region between the inner bead 9A, 9B and the outer bead 8 (the region corresponding to the rubbed region for engagement) R is clamped firmly by the rubbed regions for engagement of the punch 11 and the knockout 12 in press work for producing the shadow mask. On the other hand, the region inside (on the tube axis side with respect to) the region R corresponding to the rubbed region for engagement is clamped by the machine-processed regions of the punch 11 and the knockout 12. It should be noted that, as shown in FIGS. 8 and 9, a region R' between the inner bead 109A, 109B and the perforated portion 61 conventionally has been clamped by the rubbed regions for engagement of the punch 11 and the knockout 12.

It is difficult to hold the region inside the region R corresponding to the rubbed region for engagement by the punch 11 and the knockout 12 as firmly as the region R corresponding to the rubbed region for engagement. However, since unrubbed holding surfaces of the punch 11 and the knockout 12 are formed by machine processing, they have much less work unevenness than the rubbed region for engagement. Also, even when wrinkles are generated in the region R corresponding to the rubbed region for engagement due to the work unevenness in the rubbed region for engagement, it still is possible to prevent the wrinkles from reaching the perforated portion 61 because the inner bead 9A, 9B is formed between the region R corresponding to the rubbed region for engagement and the perforated portion 61. Consequently, the generation of wrinkles in the perforated portion 61 can be suppressed.

Herein, the effects of the present invention will be described by way of examples. By changing the spacing A between the inner bead 9A, 9B and the outer bead 8 in the non-perforated portion 62, which was the region corresponding to the rubbed region for engagement, two kinds of shadow masks with a configuration similar to that shown in FIGS. 1 and 2 (shadow masks of Example 1 and Example 2) were produced. For comparison, by changing the spacing A between the inner bead 9A and the outer bead 8 in the longer side portion 62A of the non-perforated portion 62 and providing the region between the inner bead 9A and the perforated portion 61 as the region corresponding to the rubbed region for engagement, two kinds of conventional shadow masks (shadow masks of Comparative Example 1 and Comparative Example 2) were produced. Further, a shadow mask whose spacing A between the inner bead 9A and the outer bead 8 did not satisfy the numerical range of the invention of the present application (a shadow mask of Comparative Example 3) was produced. For all of the above five kinds of shadow masks, the cross-sections of the inner beads 9A and 9B and the outer bead 8 had a substantially semi-circular shape with a diameter of about 3 mm, and the spacing between the perforated portion 61 and the center of the outer bead 8 was constant (8 mm). Each of the shadow masks was formed of an Invar material (a Fe-36% Ni alloy) with a thickness of 0.25 mm. As the longitudinal pitch of the aperture trains, a variable pitch that increased gradually from the central part (the minor axis) toward major axis ends (points on the edge of the perforated portion 61 that the major axis crosses) along the major axis direction was adopted; i.e., about 0.7 mm near the central part and about 0.9 mm near the major axis ends. The surface of the perforated portion 61 of each of the five kinds of produced shadow masks was observed visually, thus evaluating a wrinkle level. The wrinkle levels were ranked on a scale of four levels: "A" showing substantially no wrinkles, "B" slightly showing wrinkles but causing no problem in use, "C" showing wrinkles causing problems in use, and "D" showing conspicuous wrinkles hampering use. The results are shown together in Table 1.

TABLE 1

| | Comp. Ex. 1 | Comp. Ex. 2 | Comp. Ex. 3 | Ex. 1 | Ex. 2 |
|---|---|---|---|---|---|
| Spacing A | 0.5 mm | 1.0 mm | 1.0 mm Rubbing for engagement | 2.0 mm Rubbing for engagement | 3.0 mm Rubbing for engagement |
| Spacing B | 3.0 mm Rubbing for engagement | 2.5 mm Rubbing for engagement | 2.5 mm | 1.5 mm | 0.5 mm |
| Wrinkle level | D | D | C | B | A |

In Table 1 above, the spacing A indicates the spacing between the inner bead and the outer bead, and the spacing B indicates the spacing between the perforated portion and the inner bead (see FIG. 2).

The shadow mask of Example 1 in which the spacing A was 2 mm, the spacing B was 1.5 mm and the region between the inner bead and the outer bead (the region having the spacing A) was the region corresponding to the rubbed region for engagement had an excellent wrinkle level.

The shadow mask of Example 2 in which the spacing A was 3 mm, the spacing B was 0.5 mm and the region between the inner bead and the outer bead was the region corresponding to the rubbed region for engagement had a wrinkle level better than that of Example 1. This is considered to be because the width of the region corresponding to the rubbed region for engagement (the spacing A) was larger than that in Example 1, making the rubbing for engagement easier, so that highly accurate work was possible.

On the other hand, the shadow mask of Comparative Example 1 in which the spacing A was 0.5 mm, the spacing B was 3 mm and the region between the perforated portion and the inner bead (the region having the spacing B) was the region corresponding to the rubbed region for engagement had wrinkles in the perforated portion.

Also, the shadow mask of Comparative Example 2 in which the spacing A was 1 mm, the spacing B was 2.5 mm and the region between the perforated portion and the inner bead was the region corresponding to the rubbed region for engagement had wrinkles in the perforated portion similarly to Comparative Example 1.

Further, the shadow mask of Comparative Example 3 in which the spacing A was 1 mm, the spacing B was 2.5 mm and the region between the inner bead and the outer bead (the region having the spacing A) was the region corresponding to the rubbed region for engagement similarly to Examples 1 and 2 had a reduced amount of wrinkles compared with Comparative Examples 1 and 2 but still had wrinkles in the perforated portion.

As becomes clear from Table 1, compared with the cases in which the region corresponding to the rubbed region for engagement was the region between the perforated portion and the inner bead (Comparative Examples 1 and 2), the amount of wrinkles generated in the perforated portion was reduced in the cases in which the region corresponding to the rubbed region for engagement was the region between the inner bead and the outer bead (Examples 1 and 2 and Comparative Example 3).

Further, even when the region corresponding to the rubbed region for engagement was the region between the inner bead and the outer bead, in the case where the region corresponding to the rubbed region for engagement had a width smaller than 2 mm (Comparative Example 3), it was not possible to suppress the wrinkles in the perforated portion sufficiently compared with the case where it had a width of at least 2 mm (Examples 1 and 2). This is because, when the region corresponding to the rubbed region for engagement was narrow, the rubbed region for engagement also was narrow, thus deteriorating a working accuracy of the rubbing for engagement, which was a manual work.

In each of the pair of longer side portions 62A, it is preferable that the spacing A between the outer bead 8 and the inner bead 9A and the spacing B between the inner bead 9A and the perforated portion 61 satisfy A>B. This makes it possible to secure a sufficiently wide region corresponding to the rubbed region for engagement in the narrow longer side portion 62A, so that the generation of wrinkles in the perforated portion 61 can be suppressed further.

In the longer side portion 62A of the non-perforated portion 62 in the shadow mask 6 shown in FIG. 1, the spacing between the inner bead 9A and the outer bead 8 (a bead spacing) is uniform over the entire length of the longer side portion 62A. However, the bead spacing does not have to be uniform along the major axis direction. For example, the bead spacing may be largest near the central part in the major axis direction (near the minor axis) and decrease with distance away therefrom along the major axis direction. Also, in FIG. 1, in the shorter side portion 62B of the non-perforated portion 62, the spacing between the inner bead 9B and the outer bead 8 (the bead spacing) is uniform over the entire length of the shorter side portion 62B. However, the bead spacing does not have to be uniform along the minor axis direction, similarly to the bead spacing in the longer side portion 62A.

Although FIG. 1 shows the case in which the inner bead 9A in the longer side portion 62A and the inner bead 9B in the shorter side portion 62B are discontinuous, they may be continuous similarly to the outer bead 8. Further, although FIG. 1 shows the case in which the outer bead 8 in the longer side portion 62A and the outer bead 8 in the shorter side portion 62B are continuous, they may be discontinuous similarly to the inner beads 9A and 9B.

FIG. 1 shows the case in which a longer side of the perforated portion 61 is covered completely with the inner bead 9A of the longer side portion 62A facing this longer side, namely, the case in which the longer side of the perforated portion 61 is shorter than the inner bead 9A. However, the vicinity of ends of the longer side of the perforated portion 61 does not have to be covered with the inner bead 9A of the longer side portion 62A. This is because, since the radius of curvature of the perforated portion 61 in the minor axis direction is smaller in the vicinity of the shorter sides than in the central part (near the minor axis), the extending amount of the perforated portion 61 in the vicinity of the shorter sides of the perforated portion 61 is secured easily at the time of press work even when the inner bead 9A is not formed in the vicinity of the ends of the longer side of the perforated portion 61. Additionally, FIG. 1 shows the case in which a shorter side of the perforated portion 61 is covered completely with the inner bead 9B of the shorter side portion 62B facing this shorter side, namely, the case in which the shorter side of the perforated portion 61 is shorter than the inner bead 9B. However, similarly to the inner bead 9A of the longer side portion 62A, the vicinity of ends of the shorter side of the perforated portion 61 does not have to be covered with the inner bead 9B of the shorter side portion 62B.

FIG. 1 shows the case in which the spacing between the perforated portion 61 and the inner bead 9A in the longer side portion 62A is smallest on the minor axis of the shadow mask 6 in the major axis direction and increases with distance away from the minor axis along the major axis direction. However, this spacing may be uniform over the entire length of the inner bead 9A or decrease with distance away from the minor axis along the major axis direction. Incidentally, the radius of curvature of the perforated portion 61 in the minor axis direction decreases with distance away from the central part (the vicinity of the minor axis) along the major axis direction, so that the extending amount of the perforated portion 61 at the time of press work increases with distance away from the central part (the vicinity of the minor axis) of the perforated portion 61 along the major axis direction. In particular, several apertures in the vicinity of the longer side ends of the perforated portion 61 sometimes are stretched strongly and deformed considerably. The considerable deformation of the apertures leads to a poor image at corners of the screen when the image is displayed. Accordingly, it is preferable to provide a large spacing between the perforated portion 61 and the inner bead 9A of the longer side portion 62A in the vicinity of the longer side ends so as to increase the extending amount of this portion, thus alleviating the deformation of the apertures. In other words, the case in which the spacing between the perforated portion 61 and the inner bead 9A increases with distance away from the minor axis along the major axis direction or is larger only in the vicinity of the longer side ends than in other parts is preferable.

FIG. 1 shows the case in which the spacing between the perforated portion 61 and the inner bead 9B in the shorter side portion 62B is smallest on the major axis of the shadow mask 6 in the minor axis direction and increases with distance away from the major axis along the minor axis direction. However, similarly to the longer side potion 62A, this spacing may be uniform over the entire length of the inner bead 9B or decrease with distance away from the major axis along the minor axis direction, for example. Similarly to the longer side potion 62A, the case in which the spacing between the perforated portion 61 and the inner bead 9B increases with distance away from the major axis along the minor axis direction or is larger only in the vicinity of the shorter side ends than in other parts is preferable.

Figure 4:
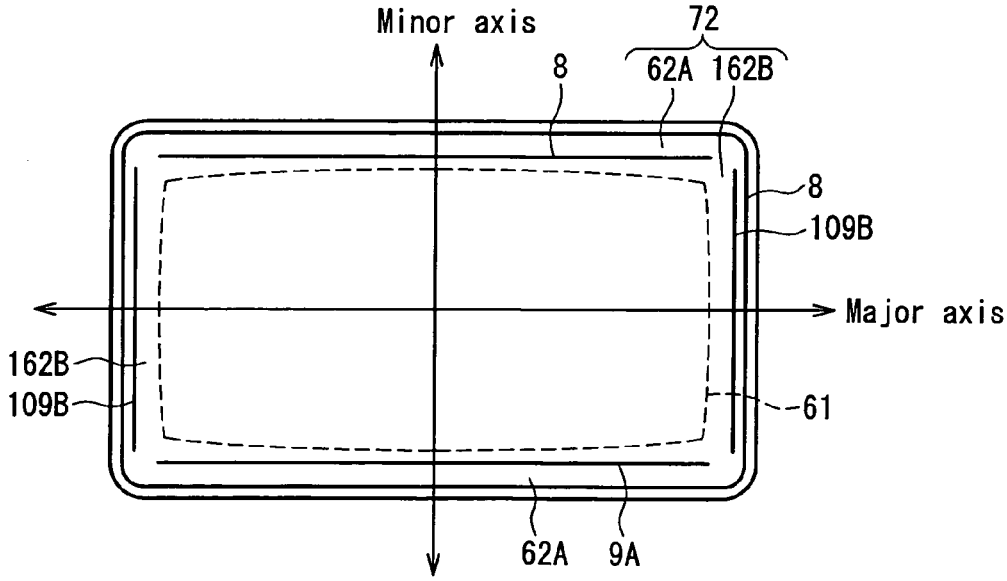
FIG. 4 is a schematic plan view showing a variation of the exemplary structure of the shadow mask in the color picture tube according to an embodiment of the present invention.

In the above description, in both of the longer side portion 62A and the shorter side portion 62B, the region between the inner bead and the outer bead serves as the region corresponding to the rubbed region for engagement and has a width of at least 2 mm. However, the present invention is not limited to the above. FIG. 4 is a schematic plan view showing a variation of the exemplary structure of the shadow mask in the color picture tube according to an embodiment of the present invention. Wavy wrinkles are generated in the perforated portion 61 mainly because of a work unevenness in the rubbed region for engagement in the mask die corresponding to the longer side portion 62A. Therefore, as shown in FIG. 4, the inner bead 109B may be formed in a shorter side portion 162B of a non-perforated portion 72 similarly to the conventional case shown in FIG. 8, for example. Furthermore, similarly to the conventional case, the region between the perforated portion 61 and the inner bead 109B may serve as the region corresponding to the rubbed region for engagement. In this case, it also is possible to suppress the generation of wrinkles caused by the work unevenness in the rubbed region for engagement of the mask die corresponding to the longer side portion 62A, thereby suppressing the generation of wrinkles in the perforated portion 61 compared with the conventional case. Incidentally, it was confirmed that substantially no wrinkles were generated in the perforated portion 61 even in the shadow mask of Example 2 described above having the same shorter side portion as that of Comparative Example 1. However, the configuration shown in FIG. 1 still is preferable in order to suppress the wrinkles in the perforated portion 61 in an excellent manner.

Although the above description is directed to the case of forming two lines of beads in the longer side portion 62A and the shorter side portion 62B, three or more lines of beads also may be formed in the longer side portion 62A and/or the shorter side portion 62B. In this case, it is appropriate that at least any one of the spacings between these adjacent two lines of beads be at least 2 mm. It also is appropriate that a region between these adjacent two lines of beads having a spacing of at least 2 mm serve as the region corresponding to the rubbed region for engagement.

Further, the above description is directed to the case in which the punch 11 of the mask die is formed of a single member. However, the present invention is not limited to this, and a plurality of members may be combined. For example, the punch 11 may be constituted by a first member inside (on the tube axis side with respect to) the depression 118 corresponding to the outer bead and a second member surrounding the first member.

There is no particular limitation on the field to which the present invention is applied. For example, the present invention can be applied preferably to a color picture tube with a face portion whose outer surface is substantially flat, in which wrinkles are generated easily in a perforated portion of a shadow mask.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube comprising:

an envelope comprising a panel having a face portion whose outer surface is substantially flat, and a funnel having a neck portion;

a phosphor screen formed on an inner surface of the face portion;

an electron gun disposed in a space inside the neck portion; and a shadow mask that is spaced away from and faces the phosphor screen, the shadow mask comprising a perforated portion having a plurality of apertures, a nonperforated portion, formed on a periphery of the perforated portion, comprising a pair of longer side portions each having an outer bead and an inner bead that are adjacent to each other and a pair of shorter side portions each having an outer bead and an inner bead that are adjacent to each other, and a skirt portion formed on a periphery of the nonperforated portion;

wherein the non-perforated portion is formed so as to extend from the perforated portion, and the skirt portion is bent from the non-perforated portion so as to be substantially parallel with a tube axis, in each of the pair of longer side portions, the outer bead extends along a longitudinal direction of the longer side portion, and the inner bead extends along the longitudinal direction of the longer side portion and is disposed between the outer bead and the perforated portion, in each of the pair of shorter side portions, the outer bead extends alone a longitudinal direction of the shorter side portion, and the inner bead extends along the longitudinal direction of the shorter side portion and is disposed between the outer bead and the perforated portion, and in each of the pair of longer side portions, a spacing between the outer bead and the inner bead is at least 2 mm.

2. The color picture tube according to claim 1, satisfying A>B, wherein in each of the pair of longer side portions, A is the spacing between the outer bead and the inner bead and B is a spacing between the inner bead and the perforated portion.

3. The color picture tube according to claim 1, wherein in each of the pair of shorter side portions, a spacing between the outer bead and the inner bead is at least 2 mm.

4. The color picture tube according to claim 1, wherein in each of the pair of longer side portions, a spacing between the perforated portion and the inner bead is smallest on a minor axis of the shadow mask in a major axis direction and increases with distance away from the minor axis along the major axis direction.

* * * * *